United States Patent [19]

Horst et al.

[11] Patent Number: 4,997,624

[45] Date of Patent: Mar. 5, 1991

[54] CONTACT MATERIAL FOR VACUUM SWITCHES AND PROCESS FOR MANUFACTURING SAME

[75] Inventors: Kippenberg Horst, Herzogenaurach; Christian Hannelore, Hemhofen, both of Fed. Rep. of Germany

[73] Assignee: Siemens Aktiengesellschaft, Berlin & Munich, Fed. Rep. of Germany

[21] Appl. No.: 458,696

[22] Filed: Jan. 19, 1990

[30] Foreign Application Priority Data

Jul. 28, 1987 [DE] Fed. Rep. of Germany ..... 3724990

[51] Int. Cl.[5] ..... C22B 4/00; H01H 1/02

[52] U.S. Cl. ..... 420/500; 75/10.23; 148/11.5 P

[58] Field of Search ..... 75/10.23; 420/500; 148/11.5 P; 200/265, 266

[56] References Cited

U.S. PATENT DOCUMENTS

| | | | |
|---|---|---|---|
| 3,596,027 | 7/1971 | Okutomi et al. | 200/144 B |
| 4,749,830 | 6/1988 | Kippenberg et al. | 200/144 B |
| 4,853,184 | 8/1989 | Naya et al. | 420/489 |
| 4,906,291 | 3/1990 | Moser et al. | 75/10.23 |
| 4,927,989 | 5/1990 | Naya et al. | 200/265 |

FOREIGN PATENT DOCUMENTS

| | | |
|---|---|---|
| 0083200 | 7/1983 | European Pat. Off. . |
| 0083245 | 7/1983 | European Pat. Off. . |
| 0109088 | 5/1984 | European Pat. Off. . |
| 0172912 | 3/1986 | European Pat. Off. . |
| 2240493 | 3/1974 | Fed. Rep. of Germany . |
| 2254623 | 5/1974 | Fed. Rep. of Germany . |
| 3006275 | 9/1980 | Fed. Rep. of Germany . |

*Primary Examiner*—Upendra Roy
*Attorney, Agent, or Firm*—Kenyon & Kenyon

[57] ABSTRACT

Contact materials for vacuum switches with the base constituents copper and chromium and additive constituents containing tellurium or selenium and in which copper-telluride ($Cu_2Te$) or copper-selenide ($Cu_2Se$) are formed as a binary intermetallic phase are known. According to the invention, the additive constituent is a ternary intermetallic phase composed of copper, chromium and tellurium or copper, chromium and selenium with a tellurium or selenium content which is greater than that of the known binary intermetallic phases. This results in a reduction of the chopping currents in the contact pieces manufactured from the contact material according to the invention and causes the overvoltage performance to be enhanced.

12 Claims, 1 Drawing Sheet

CONTACT MATERIAL FOR VACUUM SWITCHES AND PROCESS FOR MANUFACTURING SAME

Figure 1:
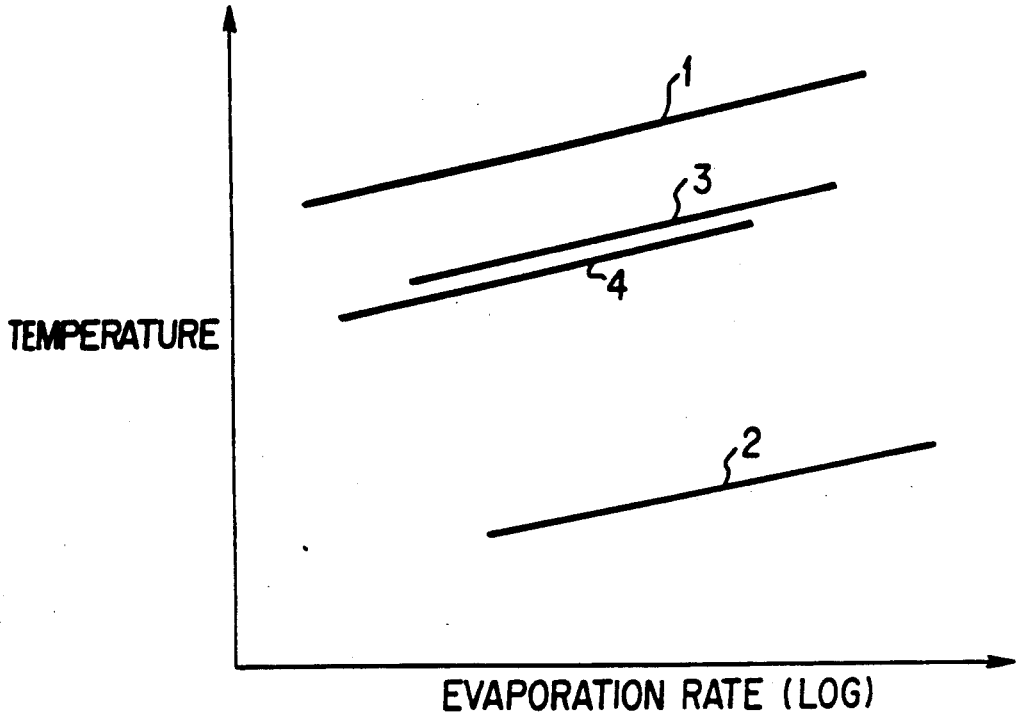

The invention relates to a contact material for vacuum switches consisting of the base constituents copper (Cu) and chromium as well as of an additive constituent tellurium (Te) or selenium (Se).

Materials with a copper and chromium base have proved successful as contact materials for vacuum switches and are known in the prior art in a great variety of modifications. In special switching cases, distinctively low chopping currents and overvoltages are called for, whereby inductive circuits in particular require avoiding multiple re-ignitions and virtual chopping currents. In the specialized literature, a series of solutions have been proposed which attempt to fulfill the last-mentioned requirements by adding further constituents to the CrCu contact material.

Among the proposed constituents, tellurium (Te) or selenium (Se) are identified as preferable. Due to their high vapor pressures, they can promote the so-called required "soft" switching performance. Some examples of this from the patent literature are DE-PS 22 40 493, DE-AS 30 06 275, EP-B-0 0 083 200 and EP-A-0 0 172 912.

Together with copper, the additives tellurium or selenium form intermetallic phases, according to the phase diagrams from Hansen "Constitution of Binary Alloys", Springer publishing House (1958). These intermetallic phases possess, on the one hand, melting points which are higher than the melting point of copper and thus enable the contact materials containing the phases to be hard-soldered, as indicated in DE-PS 22 54 623. However, since such phases have a distinctly lower vapor pressure than the starting materials tellurium and selenium, the desired physical property of a high vapor pressure is noticeably decreased. As a consequence, therefore, limits are set to the process of reducing the chopping currents and voltage instabilities, since the pure additive itself is no longer decisive, but rather the intermetallic phase formed by the pure additive is the determining factor.

In addition to this, as a rule, the intermetallic phase does not exist completely on the switching surface of the contact pieces manufactured from the contact materials; rather it is found there in a given portion only, together with the constituents chromium and copper. This constitution must be selected, because, on the one hand, a minimum portion of chromium is desired to make the contact material burn-resistant and to provide an adequate getter effect. On the other hand, a minimum portion of copper is likewise needed due to the current carrying and switching capacity requirements. This means that it is not possible to replace as much copper as desired with the less conductive telluride or selenide. Reducing the concentration of the intermetallic phase in the switching surface therefore usually weakens the desired lowering effect on the chopping current.

Therefore, one is interested in improving the lowering effect that the constituents tellurium and selenium have on the chopping current without giving up the advantages of CrCu contact materials by use of Te- or Se-additives which guarantee a sufficient soldering strength, low burn-off and high switching capacity.

The object of the invention is therefore to specify a contact material and the requisite manufacturing process, which fulfill the latter conditions and, in particular, provide a switching performance, which is substantially free of overvoltage.

The objective is solved, according to the invention, by the entirety of the characteristic of patent claim 1. The embodiment of this claim thereby contains in particular the characteristics which are new compared to the older, not prepublished European Pat. Application No. 87100621.9 (US-A-4 749 830). Advantageous further developments are specified in the subclaims 2 to 6, and a method for manufacturing the material, according to the invention, is indicated in the method claim 7.

Thus in the case of the invention, the copper-telluride ($Cu_2Te$) or copper-sellenide ($Cu_2Se$) usually contained in CrCu materials is replaced with a ternary copper-chromium-telluride or copper-chromium-selenide with a specifically higher tellurium or selenium concentration. Surprisingly it was discovered in the scope of the invention, that the mentioned binary telluride or selenide can be substituted with a ternary telluride or selenide. Its melting point and vapor pressure are similar to that of the binary telluride or selenide, but its composition has a distinctly higher concentration of tellurium or selenium. This means that, given a comparable volumetric component of telluride or selenide in the CrCu-structure, a ternary CrCu-telluride or selenide additive is more advantageous than the usual binary Cu-telluride or selenide additive The ternary telluride or selenide contained in the contact material, according to the invention, can be recovered from the single constituents chromium, copper and tellurium or selenium using a smelting process. Then, in a powder form, they can be admixed in the desired amount during the CrCu-contact manufacturing and further processed using a known method. In the scope of the invention, the ternary intermetallic phase can be dispersed homogeneously in the entire CrCu-structure. However, it can also be restricted to a surface layer of the contact and, in particular, starting from the switching surface, it can be limited up to a specified depth of the material, as described in the European Pat. Application No. 87100621.9 (US-A-4 749 830).

Further details and advantages of the invention are set forth in the following description based on the figures of the drawing in conjunction with the presentation of an example.

Figure 2:
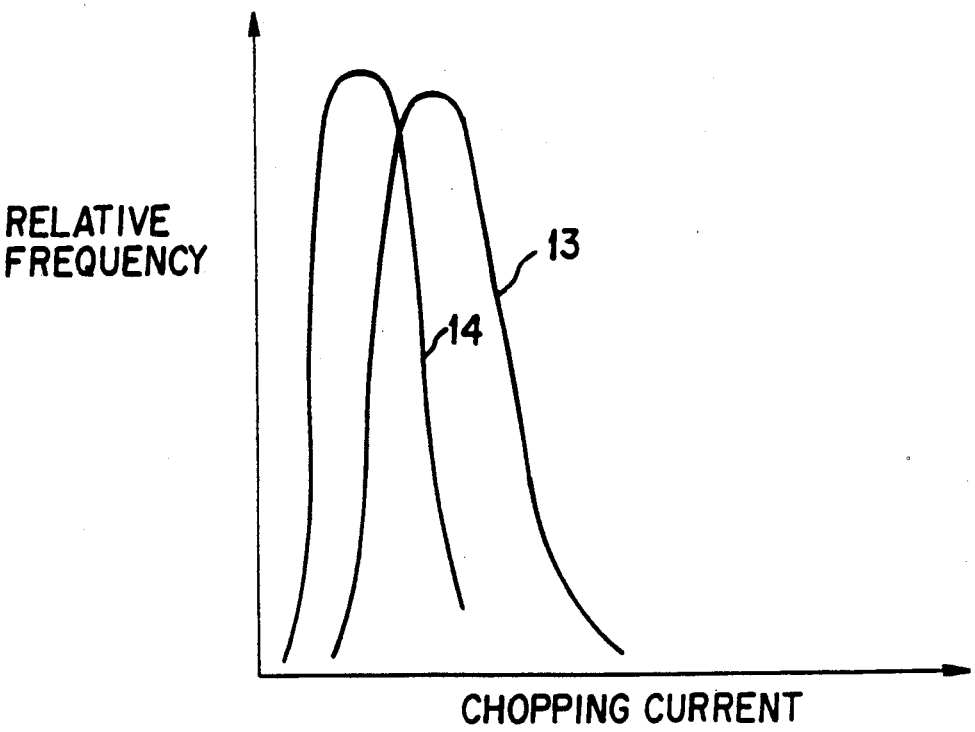

The figures illustrate in a graphic representation, respectively FIG. 1 a temperature evaporating rate diagram for single constituents in the chromium-copper-tellurium system, FIG. 2 a chopping current distribution diagram for the intermetallic phases identified in the system according to FIG. 1.

Both figures serve to qualitatively explain the invention, whereby the coordinates contain units which are not described in greater detail.

In FIG. 1, the evaporation rate is chosen logarithmically as the abscissa and the temperature as the ordinate. It is apparent from the graphs 1 for copper and 2 for tellurium that tellurium already has a considerable evaporating rate at low temperatures, on the other hand, copper requires considerably higher temperatures. The known intermetallic phase in the copper-tellurium system namely $Cu_2Te$ contains approximately 33 atom % tellurium and 67 atom % copper; the graph 3 for the evaporating rate, in this connection, lies relatively close below the copper graph 1. It was now discovered that the ternary CuCr-telluride, as proposed by the invention, which has a structural formula with the approximate stoichiometry $Cu_3Cr_2Te_4$, possesses approximately 45 atom % tellurium, whereby the residue is spread out accordingly over copper and chromium. This means, however, that the tellurium content is approximately ⅓ greater than that of the known intermetallic phase $Cu_2Te$. Nevertheless, only slightly higher evaporating rates result, as indicated by the corresponding graph 4.

In FIG. 2, the chopping current is plotted as the abscissa and the relative frequency of the current is plotted as the ordinate, so that the representation in this coordinate system provides a distribution of the chopping current. If one starts out from a known, defined chopping current distribution according to the distribution curve 13 for $Cu_2Te$, then as a consequence of the approximately one third higher tellurium portion or of the higher evaporating rate of $Cu_3Cr_2Te_4$, the chopping currents are nearly halved, as is apparent from the curve 14. Due to the more favorable chopping current distribution curve of the ternary copper-chromium-telluride of the described composition, the overvoltage performance undergoes an altogether suitable, positive influence.

As far as the content is concerned, the same applies to replacing the binary copper-selenide with a ternary copper-chromium-selenide.

EXAMPLE

A mixture of chromium, copper and tellurium powder in the mass ratio of approximately 1:2:5.5 is heated under vacuum or under protective gas to approximately 1300° C. and smelted and homogenized. Thereby, a ternary copper-chromium-telluride results with the stoichiometry of approximately $Cu_3Cr_2Te_4$. The thus produced ternary copper-chromium-telluride is triturated, scalped out to a powder size of $<100$ μm and mixed with chromium and copper-powder of a particle size distribution of likewise $<100$ μm in the mass ratio 1:2:2. This mixture is pressed with approximately 600 MPa, as an approximately 3 mm thick layer, on to a layer of approximately the same thickness made of a CrCu powder mixture of the same particle size distribution and sintered at approximately 1050° C. under vacuum.

To attain the necessary density ratio of ≧98%, additional compacting steps can be implemented, if needed. Double-layer contact facings can be machined in a cutting operation out of the thus created blank.

In further examples, contact pieces can be manufactured whereby the additive constituents with the ternary tellurides or selenides are present in the entire contact material.

We claim:

1. In a contact material for vacuum switches having base constituents copper (Cu) and chromium (Cr) as well as an additive constituent selected from the group consisting of tellurium (Te) and selenium (Se), the improvement comprising the additive constituent being a ternary intermetallic phase comprising copper (Cu), chromium (Cr) and a member selected from the group consisting of tellurium (Te) and selenium (Se) wherein when said selected member is tellurium (Te), said tellurium (Te) has a concentration which is higher than that of a binary intermetallic phase with stoichiometry $Cu_2Te$, and wherein when said selected member is selenium (Se), said selenium (Se) has a concentration which is higher than that of a binary intermetallic phase with the stoichiometry $Cu_2Se$.

2. A contact material according to claim 1 wherein the concentration of Te in the ternary intermetallic phase is greater than 40 atom %.

3. A contact material according to claim 1 wherein the concentration of Se in the ternary intermetallic phase is greater than 40 atom %.

4. A contact material according to claim 1 wherein the ternary intermetallic phase has an approximate structural formula of $Cu_3Cr_2Te_4$.

5. A contact material according to claim 1 wherein the ternary intermetallic phase has an approximate structural formula of $Cu_3Cr_2Se_4$.

6. A contact material according to claim 1 wherein the additive constituent is evenly dispersed in the contact material.

7. A contact material according to claim 1 wherein the additive constituent is evenly dispersed in a layer of the contact material which extends from a switching surface to a preselected depth in the contact material.

8. A contact material according to claim 6 wherein the additive constituent is present in the entire contact material in a concentration of approximately 10 to 60 percent by weight.

9. A contact material according to claim 7 wherein the additive constituent is present in said layer in a concentration of approximately 10 to 60 percent by weight.

10. A contact material according to claim 8 wherein said concentration is approximately 30 to 40 percent by weight.

11. A contact material according to claim 9 wherein said concentration is approximately 30 to 40 percent by weight.

12. A method for manufacturing a contact material comprising:

smelting a mixture of copper (Cu), chromium (Cr) and a member selected from the group consisting of tellerium (Te) and selenium (Se);

forming said smelted mixture into powder to provide a powdery additive constituent for said contact material;

providing copper (Cu) and chromium (Cr) in powder form to provide a powdery base constituent for material.

mixing said powdery base constituent and said powdery additive constituent;

forming said mixed powdery base constituent and powdery additive constituent into a layer;

compressing said layer; and sintering said compressed layer.

* * * * *

UNITED STATES PATENT AND TRADEMARK OFFICE

CERTIFICATE OF CORRECTION

PATENT NO. : 4,997,624

DATED : March 5, 1991

INVENTOR(S) : Horst Kippenberg et al.

It is certified that error appears in the above-identified patent and that said Letters Patent is hereby corrected as shown below:

On Title page of the patent, line 2, delete "Horst et al." and insert -- Kippenberg et al. --.

On Title page of the patent at item [75] Inventors:, delete "Kippenberg Horst" and insert -- Horst Kippenberg --; delete "Christian Hannelore" and insert -- Hannelore Christian--.

Signed and Sealed this

Fifteenth Day of September, 1992

*Attest:*

DOUGLAS B. COMER

*Attesting Officer*

*Acting Commissioner of Patents and Trademarks*